US007128216B2

(12) United States Patent
Kokko

(10) Patent No.: US 7,128,216 B2
(45) Date of Patent: Oct. 31, 2006

(54) CLOSED AIR CIRCULATION SYSTEM

(75) Inventor: Pekka Kokko, Hollola (FI)

(73) Assignee: Andritz Oy, Helsinki (FI)

( * ) Notice: Subject to any disclaimer, the term of this patent is extended or adjusted under 35 U.S.C. 154(b) by 368 days.

(21) Appl. No.: 10/380,743

(22) PCT Filed: Sep. 19, 2001

(86) PCT No.: PCT/FI01/00813

§ 371 (c)(1),
(2), (4) Date: Mar. 19, 2003

(87) PCT Pub. No.: WO02/24349

PCT Pub. Date: Mar. 28, 2002

(65) Prior Publication Data

US 2004/0035759 A1 Feb. 26, 2004

(30) Foreign Application Priority Data

Sep. 20, 2000 (FI) ..... 20002073 U

(51) Int. Cl.
*B07C 5/00* (2006.01)

(52) U.S. Cl. ..... 209/639; 209/644; 209/638; 209/637; 209/133; 209/715

(58) Field of Classification Search ..... 209/644, 209/639, 638, 637, 133
See application file for complete search history.

(56) References Cited

U.S. PATENT DOCUMENTS 2,051,570 A 8/1936 Norton et al. ..... 209/137
2,679,316 A * 5/1954 Ruepp ..... 209/11
3,720,307 A 3/1973 Hukki ..... 209/10
3,794,251 A * 2/1974 Williams ..... 241/65
4,230,559 A * 10/1980 Smith ..... 209/139.1
4,242,197 A 12/1980 Voelskow et al. ..... 209/3
5,568,896 A * 10/1996 Adams et al. ..... 241/24.29
5,579,920 A * 12/1996 Garabedian et al. ..... 209/139.1
5,829,597 A * 11/1998 Bielagus ..... 209/29
6,283,300 B1 * 9/2001 Bielagus et al. ..... 209/29

(Continued)

FOREIGN PATENT DOCUMENTS

DE 626782 2/1936

(Continued)

OTHER PUBLICATIONS

International Search Report for International Patent No. PCT/FI01/00813, completed Dec. 20, 2001.

*Primary Examiner*—Joseph Rodriguez
*Assistant Examiner*—Jonathan R. Miller
(74) *Attorney, Agent, or Firm*—Alix, Yale & Ristas, LLP

(57) ABSTRACT

The invention relates to a closed air circulation system for an apparatus used for sorting wood chips, containing chips in a variety of sizes and/or fines particles, in a wood chips processing chamber, in separate fractions by means of a gas flow, which is delivered from one or more nozzle chambers by way of a nozzle slit into the wood chips processing chamber and which applies an impulse action to the processing-bound wood chips sliding along an inclined support surface. Air is circulated from the wood chips processing chamber by way of a dedusting cyclone into said one or more nozzle chambers. The wood chips processing chamber is maintained at a negative pressure by regulating the volume of air removed from the chamber. A conduit extending between the wood chips processing chamber and the one or more nozzle chambers is open to the ambient atmosphere.

8 Claims, 2 Drawing Sheets

Figure 1:
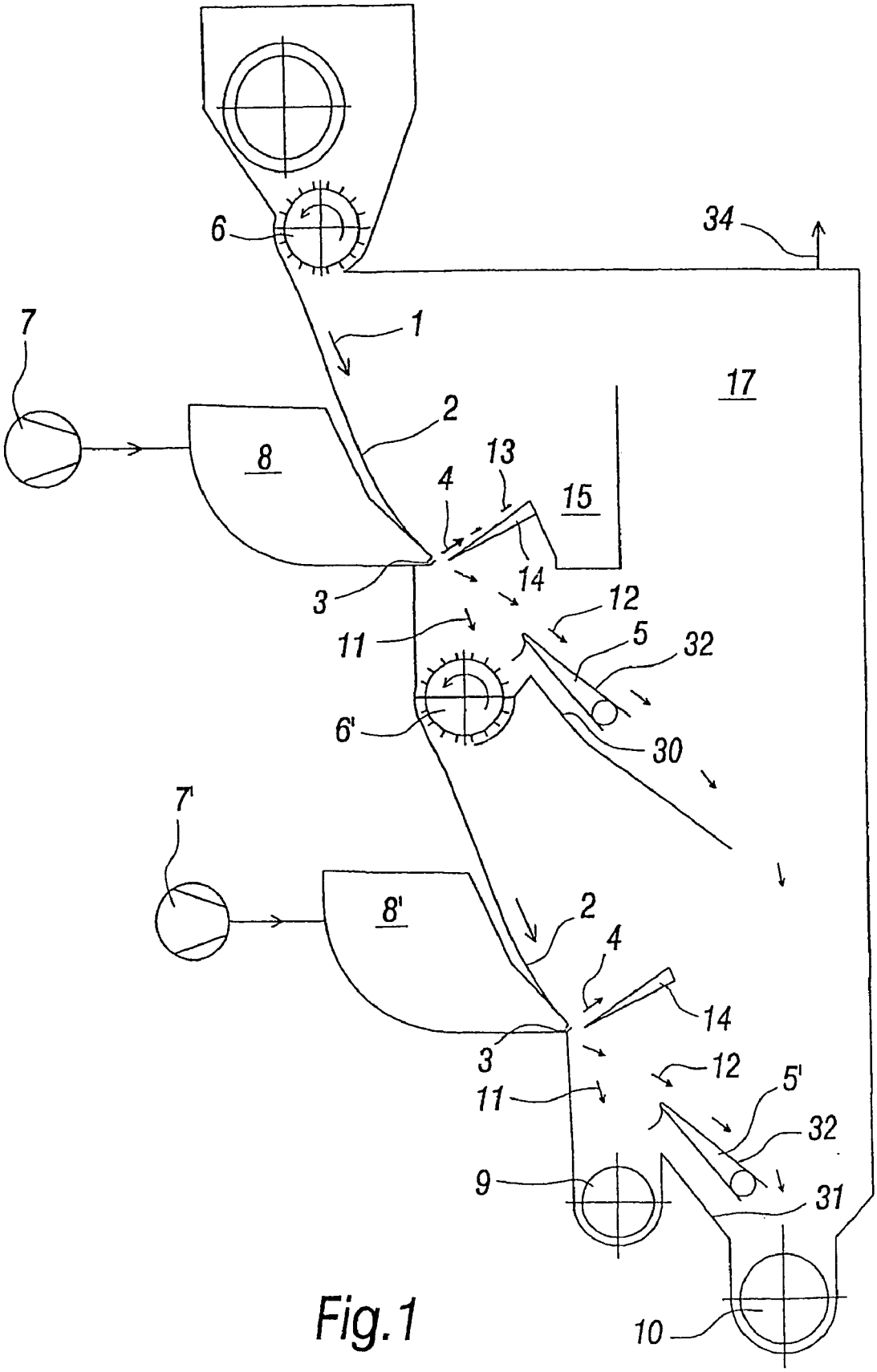

U.S. PATENT DOCUMENTS 6,464,826 B1 * 10/2002 Safstrom et al. ..... 162/23

FOREIGN PATENT DOCUMENTS

DE 299 01 453 U 1 7/1999
DE 299 01 453 U1 9/1999
FR 820.513 11/1937
WO WO87/06506 * 11/1987

* cited by examiner

CLOSED AIR CIRCULATION SYSTEM

CROSS REFERENCE TO RELATED APPLICATIONS

This application is the National Phase of International Application No. PCT/FI01/00813, filed Sep. 19, 2001 and claims the benefit of Finnish Patent Application No. 20002073, filed Sep. 20, 2000.

BACKGROUND OF THE INVENTION

1. Field of the Invention

The invention relates to an apparatus used for sorting wood chips, and more particularly to a closed air circulation system for an apparatus for sorting wood chips.

2. Description of the Related Art

An apparatus for sorting wood chips to which the invention relates sorts chips of a variety of sizes and including fines particles, in a wood chips processing chamber, in separate fractions by means of a gas flow, which is delivered from one or more nozzle chambers by way of a nozzle slit into the wood chips processing chamber and which applies an impulse action to a layer of wood chips sliding along an inclined support surface.

The above type of apparatus is necessarily provided with circulation of air, on the one hand because of aspects relating to energy economy, and on the other hand because of a dust problem. However, operation of the apparatus itself sets strict limits to facilities of implementing circulation in order not to cause trouble for the apparatus in terms of its operation.

SUMMARY OF THE INVENTION

It is an object of the invention to provide a closed air circulation system for the above type of apparatus, said air circulation system securing faultless operation of the apparatus for its part.

According to the invention, this object is accomplished in such a way that, and an air circulation system of the invention is characterized in that air is circulated from the wood chips processing chamber by way of a dedusting cyclone into said one or more nozzle chambers.

The wood chips processing chamber is adapted to be maintained at a negative pressure with respect to atmospheric pressure, such that the inevitable bleeding points present in the processing chamber—e.g. outlet ports for conveyors—do not release dust to environment. Thus, the arrangement is preferably such that the wood chips processing chamber has its negative pressure adapted to be maintained at a predetermined level by regulating the amount of air to be absorbed from the processing chamber into the dedusting cyclone.

In order to maintain pressure ratios in balance, the air to be circulated is adapted to be circulated through a duct or a chamber open to atmosphere. The duct or chamber open to atmosphere is preferably included in a pipe extending from the dedusting cyclone to the nozzle chamber. The pipe extending from the dedusting cyclone to the duct or chamber open to atmosphere is provided with a fan for regulating pressure in the processing chamber.

The pipe extending from the duct or chamber open to atmosphere is also provided with a fan. Thus, pressure in the nozzle chamber is preferably adapted to be regulated by means of said fan.

By virtue of said duct or chamber open to atmosphere, transient pressure fluctuations are equalized with the result that, on the one hand, there will be no significant discharges to atmosphere and, on the other hand, the apparatus performs its operation within set limits.

Figure 2:
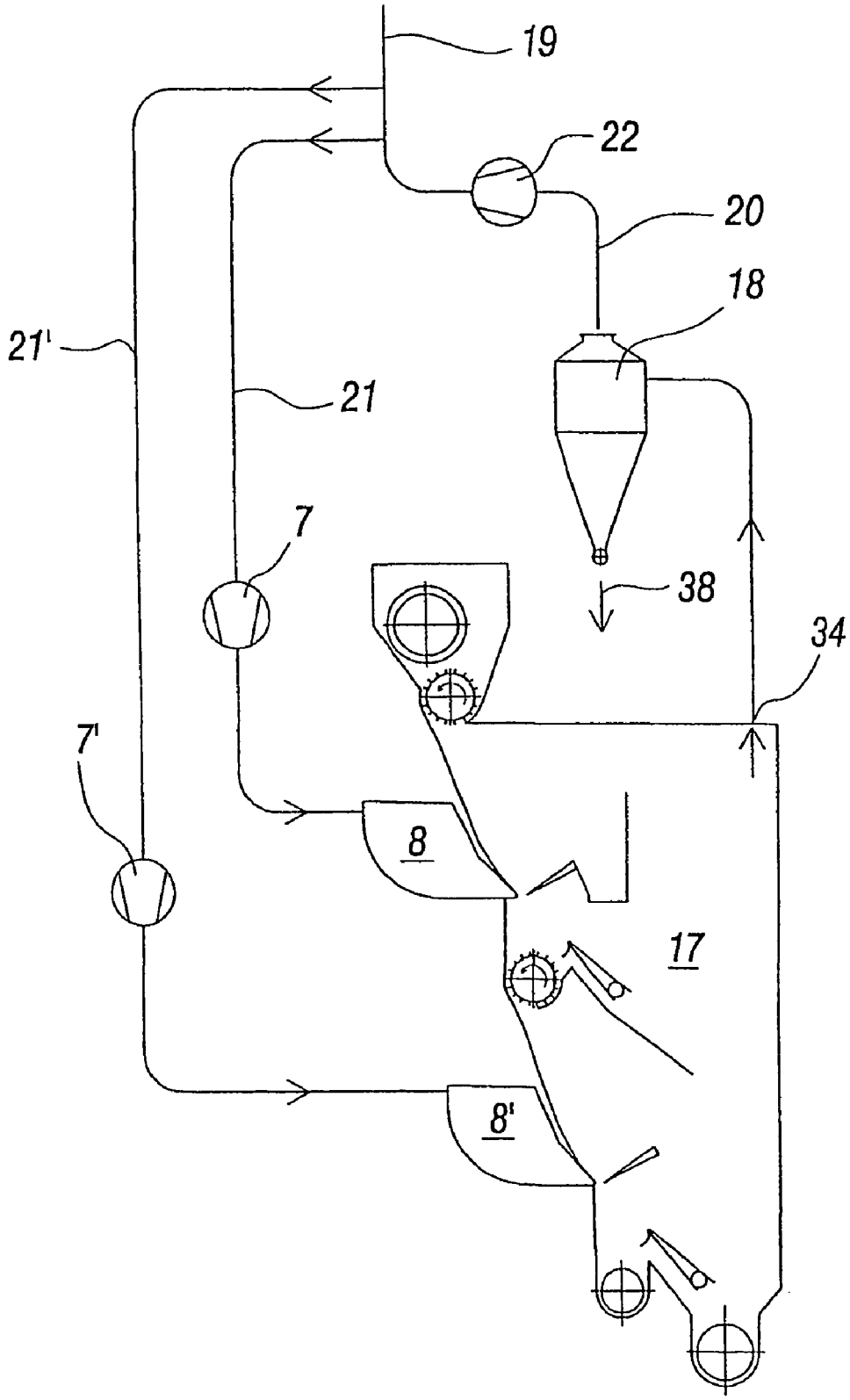

The invention will now be described in more detail with reference to the accompanying drawings, in which:

FIG. 1 is a diagrammatic vertical section of an apparatus for sorting wood chips in a closed processing chamber by the application of an impulse action; and FIG. 2 is a diagrammatic section of a closed air circulation system applied to the apparatus of FIG. 1.

DETAILED DESCRIPTION OF AN EXEMPLARY EMBODIMENT

FIG. 1 shows schematically an apparatus for sorting wood chips 1 in separate fractions. Fines particles 13, possibly contained in the wood chips 1, are sorted out to form a separate fraction and individual chips 11, 12 are determined by the thickness thereof as excess thickness chips 11 (reject) and accepted chips 12 (accept).

The apparatus comprises a feeder 6 for supplying the wood chips 1 onto a sloping support surface 2 for a substantially single layer. The individual chips 11, 12 settle in a natural way on the support surface 2 to rest upon the largest surface thereof, i.e. in the case of wood chips, upon the longitudinal/lateral surface thereof.

The support surface 2 is a solid, plain, and durable flat surface, which forms a steeply sloping slide surface for the wood chips 1 to be sorted.

The wood chips 1 emerging from the feeder 6 are first adapted to slide down the sloping support surface 2 and then over a slit 3 arranged across the support surface, said slit being adapted to deliver an impulse action 4 directed away from said support surface 2 and applied to one or more chips 11, 12 or fines particles 13 presently in line with the slit. The impulse action is adapted to be produced by means of a gas flow 4, preferably an air flow. The impulse action 4 may have a direction which is perpendicular to the support surface 2, or also at an oblique angle relative to the support surface 2.

The air flow is generated by a fan 7. In order to secure uniformity of the impulse action 4, a nozzle chamber 8 is arranged between the fan 7 and the slit 3.

The varying thickness chips 11, 12 and the eventual fines particles 13 are adapted to be separated from each other along various trajectories defined by the impulse action 4 for the particles to be sorted.

The fines particles 13, which are smaller in size than the width of the slit 3, adopt a maximum deviation of velocity and, thus, are adapted to be diverted by the action of a baffle/guide plate 14 in a separate fraction into a chute 15.

The individual chips 11, 12, which are substantially larger in size than the width of the slit 3 and, thus, heavier than said fines particles 13, adopt a deviation of velocity substantially less than that adopted by the fines particles 13 when present in line with the slit 3. A pressure-generated impulse sends the individual chips 11, 12 flying in different trajectories defined by a chip thickness, and the flow of chips is divided in separate fractions by means of a separating wall 5. The averagely minimum thickness chips 12 fly over the separating wall 5 and are further guided to a discharge screw 10. Respectively, the averagely maximum thickness chips fly a shorter distance and fall into a feeder 6' present between the separating wall 5 and the slit 3.

In the illustrated example, the averagely maximum thickness chips 11 received in the feeder 6' are reprocessed in a lower second apparatus, whereby a fraction thereof (the averagely lightest fraction) is guided over a separating wall 5' further onto the discharge screw 10, and another fraction (the averagely heaviest fraction) falls into a chute fitted between the separating wall 5' and the slit 3 and provided with a discharge screw 9.

Processing of the wood chips 1 is all in all adapted to take place in a dustproof processing chamber 17. The discharge of air from the chamber 17 is arranged through an opening represented by reference numeral 34.

FIG. 2 depicts diagrammatically a closed air circulation system for an apparatus as illustrated in FIG. 1.

In the solution of FIG. 2, air is circulated from the wood chips processing chamber 17 by way of a dedusting cyclone 18 into nozzle chambers 8, 8'.

The wood chips processing chamber 17 is adapted to be maintained at an underpressure with respect to ambient air pressure. Thus, eventual bleeding points present in the processing chamber 17 do not release dust to environment. The wood chips processing chamber 17 has its underpressure adapted to be maintained at a predetermined level by regulating the amount of air to be absorbed from the processing chamber 17 into the dedusting cyclone 18.

In order to enable the absorption of dust-mixed air uniformly across the entire width of the processing chamber 17, the intake opening 34 is adapted to extend across the entire width of the chamber 17.

The air to be circulated is adapted to be passed through a duct or chamber 19, which is in communication with the dedusting cyclone 18 by way of a pipe 20 and with the nozzle chambers 8, 8' by way of pipes 21, 21'.

The pipe 20 is provided with a fan 22, whereby pressure in the processing chamber 17 can be regulated. The fan 22 is used for absorbing dust-bearing air from the processing chamber 17. The air passes through the deducting cyclone 18, the dust separating and discharging from the cyclone (an arrow 38).

A fan 7 present in the pipe 21 is used for regulating pressure in the nozzle chamber 8, and thus the pressure of the gas flow 4 emerging from the slit 3. Respectively, a fan 7' present in the pipe 21' regulates pressure in the nozzle chamber 8'.

By virtue of the duct or chamber 19 open to atmosphere, transient pressure fluctuations are equalized with the result that there will be no significant discharges to atmosphere and, on the other hand, the fans 22; 7, 7' do not have an adverse effect on each other.

While an exemplary embodiment of the foregoing invention has been set forth for purposes of illustration, the foregoing description should not be deemed a limitation of the invention disclosed herein. Accordingly, various modifications, adaptations and alternatives may occur to one skilled in the art without departing from the spirit and the scope of the present invention.

The invention claimed is:

1. An apparatus for sorting wood chips, containing chips in a variety of sizes and/or fines particles, in a wood chips processing chamber, in separate fractions by means of an air flow, which is delivered from one or more nozzle chambers by way of a nozzle slit into the wood chips processing chamber and which applies an impulse action to the wood chips as the wood chips slide along an inclined support surface to sort the chips into said separate fractions within the processing chamber, said air being circulated from the wood chips processing chamber by way of a dedusting cyclone into said one or more nozzle chambers, the improvement comprising:

a closed air circulation system in which air flow from the wood chips processing chamber to the dedusting cyclone is controlled by an exhaust fan and air flow from the nozzle chamber into the processing chamber is controlled by a nozzle fan downstream of the exhaust fan;

a pipe arranged between the exhaust fan and the nozzle fan extending from the dedusting cyclone to the nozzle chamber, wherein said pipe is in direct communication with an ambient atmosphere; and a negative pressure in the wood chips processing chamber is maintained at a predetermined level in dependency on said exhaust fan to regulate the amount of air removed from the wood chips processing chamber into the dedusting cyclone.

2. A system as set forth in claim 1, wherein the exhaust fan is positioned in the pipe extending from the dedusting cyclone to a chamber in said pipe that is open to the ambient atmosphere.

3. A system as set forth in claim 1, wherein the nozzle fan is positioned in the pipe extending from the nozzle chamber to a chamber in said pipe that is open to the ambient atmosphere.

4. A system as set forth in claim 1, wherein said pipe extending from the dedusting cyclone to the nozzle chamber in communication with an ambient atmosphere equalizes transient pressure fluctuations and maintains the pressure ratio within said system.

5. A system as set forth in claim 1, wherein said nozzle fan regulates the pressure in said nozzle chamber.

6. A closed air circulation system for an apparatus that sorts wood chips into separate fractions by exposing wood chips sliding on an inclined support surface to a flow of air from a nozzle slit extending laterally across the support surface, said closed air circulation system comprising:

the inclined surface and the nozzle slit;

a wood chips processing chamber substantially enclosing the inclined surface and nozzle slit;

an exhaust fan arranged to exhaust air from said chamber and maintain said chamber at a negative pressure with respect to atmospheric pressure;

a dedusting cyclone arranged to receive air exhausted from said chamber;

a nozzle fan generating air flow into a pressurized nozzle chamber in communication with said nozzle slit to sort the chips into said separate fractions within the processing chamber; and a conduit in communication with said nozzle chamber and said dedusting cyclone in which exhaust air flows from the cyclone to the nozzle chamber;

wherein said conduit also communicates directly with the ambient atmosphere and wherein said negative pressure is maintained at a predetermined value by regulating the amount of air exhausted from said chamber.

7. The closed air circulation system of claim 6, wherein said exhaust fan is arranged in said conduit between said dedusting cyclone and a location where said conduit communicates with said ambient atmosphere.

8. The closed air circulation system of claim 6, wherein said nozzle fan is arranged in said conduit between said nozzle chamber and said location where said conduit communicates with said ambient atmosphere.

* * * * *